United States Patent [19]

Brinkmann

[11] Patent Number: 4,584,632

[45] Date of Patent: Apr. 22, 1986

[54] MIRROR OR MIRRORED CABINET

[75] Inventor: Ulrich Brinkmann, Rothaarweg, Fed. Rep. of Germany

[73] Assignee: Metallwarenfabrik Twick & Lehrke KG, Gutersloh, Fed. Rep. of Germany

[21] Appl. No.: 634,950

[22] Filed: Jul. 27, 1984

[30] Foreign Application Priority Data

Jul. 29, 1983 [DE] Fed. Rep. of Germany ... 8321866[U]

[51] Int. Cl.[4] ..... H01R 33/00

[52] U.S. Cl. ..... 362/133; 362/226

[58] Field of Search ..... 362/133, 135, 147, 234, 362/249, 250, 253, 226; 350/600

[56] References Cited

U.S. PATENT DOCUMENTS

| | | | |
|---|---|---|---|
| 2,254,988 | 9/1941 | Adams | 362/226 |
| 3,081,397 | 3/1963 | Tantillo | 362/133 |
| 3,819,923 | 6/1974 | Schumacher | 363/226 |
| 4,047,016 | 9/1977 | Palka | 362/133 |
| 4,208,702 | 6/1980 | Wotowiec | 362/226 |
| 4,415,957 | 11/1982 | Schwartz | 362/226 |

FOREIGN PATENT DOCUMENTS

| | | | |
|---|---|---|---|
| 1406723 | 6/1965 | France | 362/133 |

*Primary Examiner*—Ronald H. Lazarus

*Attorney, Agent, or Firm*—Sprung Horn Kramer & Woods

[57] ABSTRACT

In a mirror or mirrored cabinet with at least one lamp mounted at the side, wherein the mirror or mirrored cabinet is suspended from an assembly rail that can be secured toward the wall and wherein a lamp mount, which supports the lamps, is secured to and can be released from the front of the assembly rail.

9 Claims, 3 Drawing Figures

MIRROR OR MIRRORED CABINET

BACKGROUND OF THE INVENTION

The present invention relates to a mirror on a mirrored cabinet with at least one lamp mounted at the side.

Mounting lamps on mirrors or mirrored cabinets with lamps mounted at the side has always caused problems. The lamps have for a long time been attached directly to the mirror or mirrored cabinet, which is a difficult measure in that it necessitates processing the mirror glass itself. Specifically, the glass has to be drilled through in order to attach and secure the lamps.

SUMMARY OF THE INVENTION

The object of the present invention is to thoroughly improve a mirror or mirrored cabinet of the aforesaid generic type to the extent that the lamp or lamps can be mounted more simply and easily.

This object is attained in accordance with the invention in that the mirror or mirrored cabinet is suspended from an assembly rail that can be secured toward the wall and a lamp mount, which supports the lamps, is secured to and can be released from the front of the assembly rail.

Since the lamps in this design are mounted outside of the actual mirrored area, the mirror glass is no longer called upon for attaching them. It is no longer necessary to drill through the glass with the concomitant risk of damaging the mirror.

Another advantage of the invention is that it is now possible to mount lamps subsequently with no problem.

The lamp mount can be made in two parts, consisting of a molding that is flush with the assembly rail and of a lamp socket that is attached to the assembly rail more or less perpendicular to the molding.

The assembly rail can be designed to be telescoping and slide apart, with the assembly rail consisting of an intermediate and of two headers that are attached to it in such a way as to slide longitudinally.

In a preferred embodiment, lamp terminals and a plug can be attached to each leader, and a plug can be attached to each lamp socket.

The intermediate and header can be made out of extruded sections, and the moldings and lamp sockets can be castings.

Hanger strips with hangers that point downward can be attached to the rear of the mirror or mirrored cabinet. Preferably, the hanger strips can be attached to the mirror or mirrored cabinet with double-sided adhesive tape. Alternatively, a hanger rail that parallels the assembly rail can be fastened to the back of the mirror or mirrored cabinet. The hanger rail can be fastened to the mirror or mirrored cabinet with double-sided adhesive tape.

Some preferred embodiments of the invention will now be described with reference to the attached drawings, wherein:

DETAILED DESCRIPTION OF THE PREFERRED EMBODIMENTS

Figure 1:
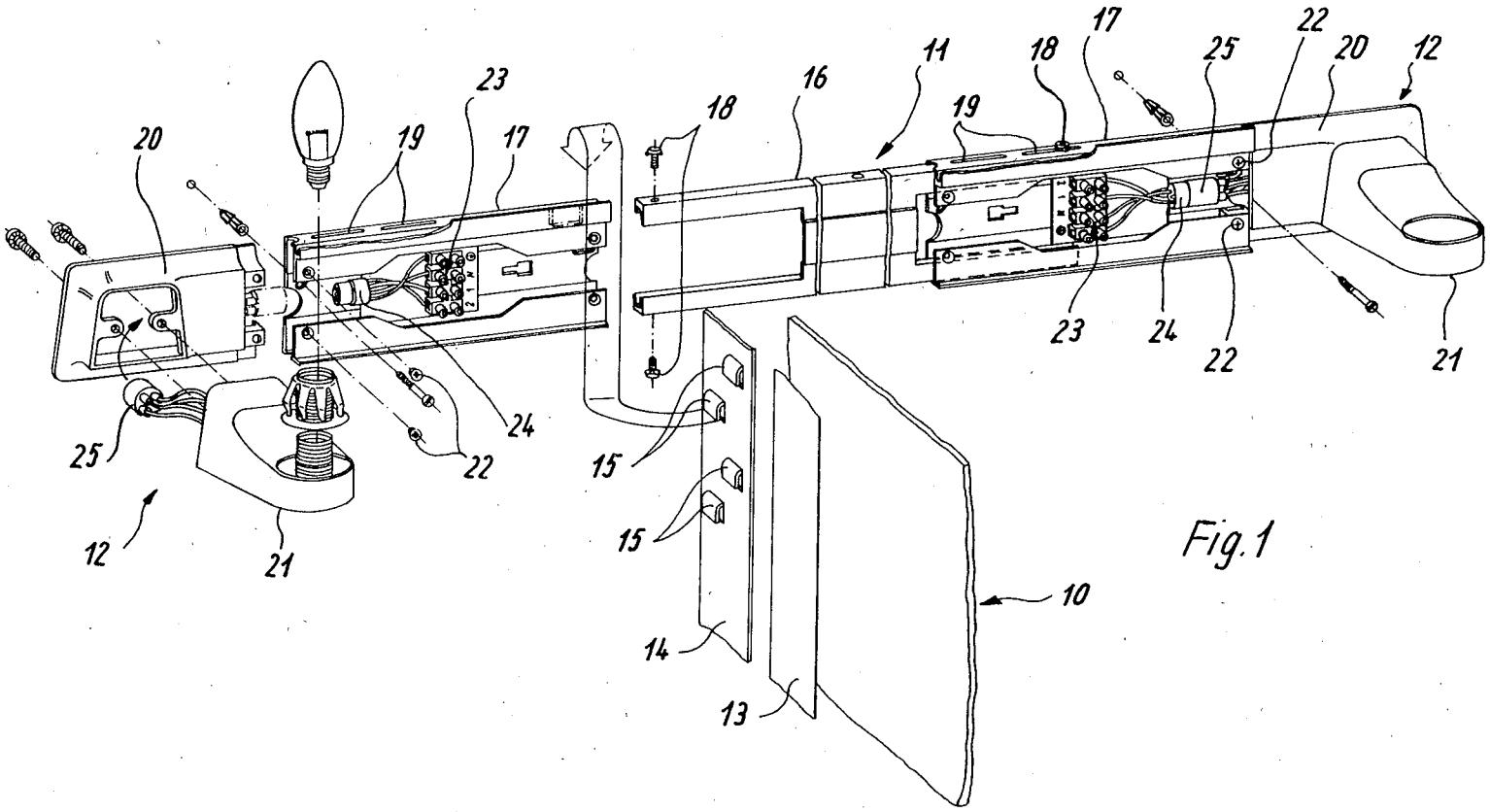
FIG. 1 is a perspective view of an assembly rail with two lamp mounts and a schematically indicated mirror attached to the assembly rail in accordance with the invention.

A mirror 10, incompletely illustrated in FIG. 1 for simplicity's sake, is suspended from an assembly rail 11 that has lamp mounts 12 on the front.

Hanger strips 14 are attached to the back of mirror 10 with double-sided adhesive tape 13. For simplicity's sake only one hanger strip 14 is illustrated, before final attachment to the rear of mirror 10, in FIG. 1.

Each hanger strip 14 has several hangers 15 pointing down on the back to allow mirror 10 to be fastened to assembly rail 11.

Figure 2:
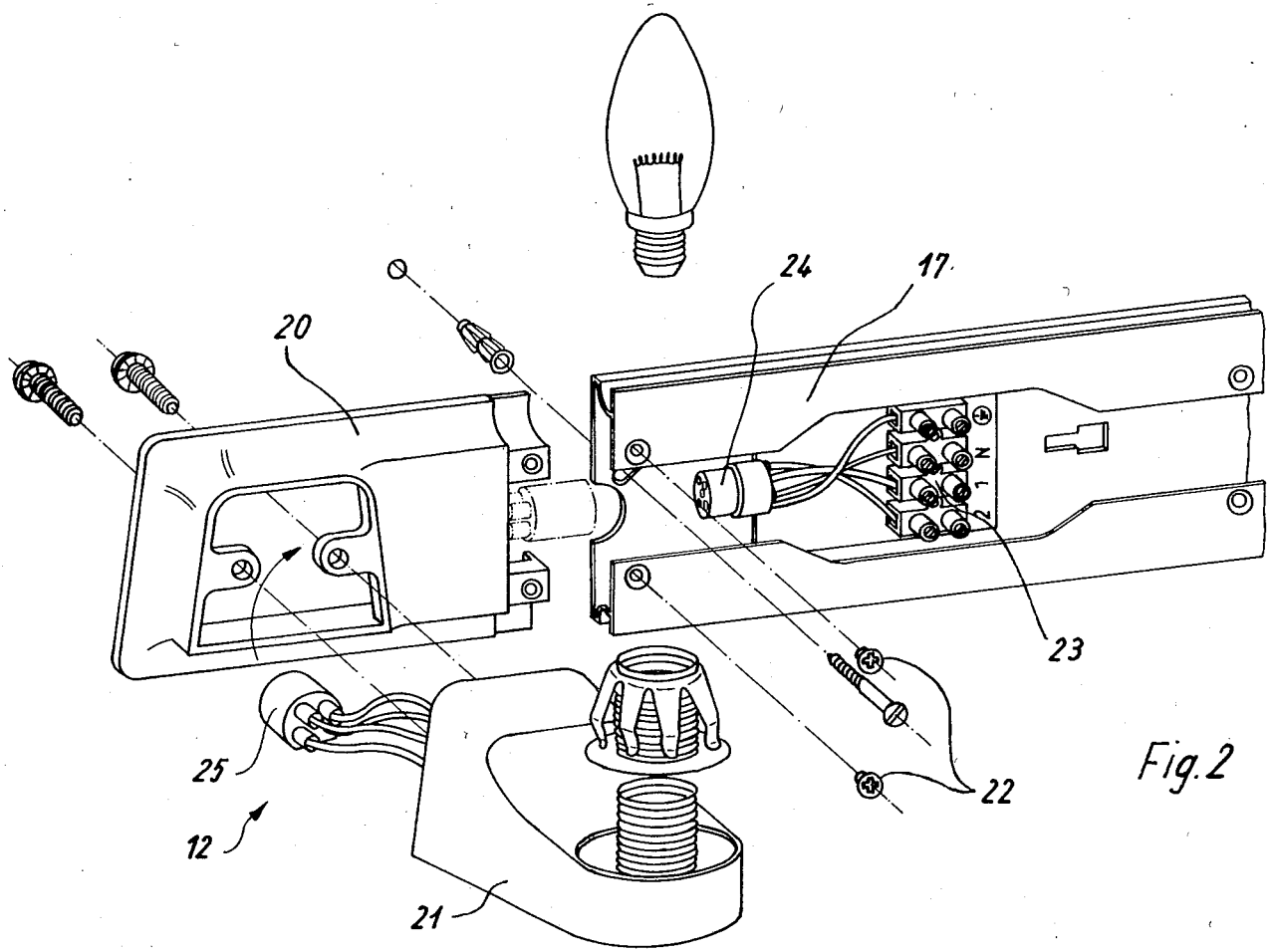
FIG. 2 is an enlarged perspective view of the front of the assembly rail in FIG. 1.

The assembly rail 11 in the embodiment illustrated in FIGS. 1 and 2 is telescoping and consists of an intermediate 16 and of two headers 17.

Headers 17 have been slid over the front ends of intermediate 16 and can be secured to in different positions by means of screws 18 that pass through slots 19 in header 17. The overall length of assembly rail 11 can accordingly be varied over a wide range.

Lamp mounts 12 are in two parts, consisting of a molding 20 that is flush with assembly rail 11 and of a lamp socket 21 that is attached to the assembly rail more or less perpendicular to the molding.

Moldings 20 are inserted into the front ends of header 17 and secured with screws 22.

Lamp terminals 23 with a plug 24 attached to them are fastened into headers 17.

Another plug 25 that constitutes a mate for each plug 24 is fastened to each lamp socket 21.

Plugs 24 and 25 are connected together once intermediate 16 and headers 17 are fastened together, moldings 20 have been connected, and lamp sockets 21 secured.

The only remaining operation is to establish an electric connection to lamp terminals 23. No additional wiring needs to be conducted or further connections established in order to complete the installation.

Assembly rail 11 with the lamp mounts 12 attached to it is now mounted in a known way on an interior wall and mirror 10 is suspended from the rail by means of hanger strips 14.

Both intermediate 16 and headers 17 are made out of extruded sections.

The advantage of the embodiment illustrated in FIGS. 1 and 2 is that it can easily be adjusted to mirrors of any size.

Figure 3:
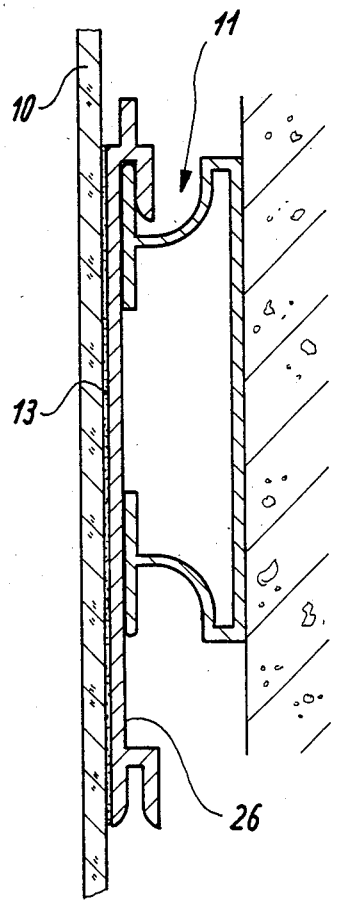
FIG. 3 is a vertical section through a mirror suspended on an assembly rail in another embodiment of the invention.

In the embodiment illustrated in FIG. 3, a hanger rail 26 that parallels the axis of assembly rail 11 on the back of mirror 10 can also be employed to suspend the mirror from the rail. Hanger rail 26 is also attached to the back of the mirror with double-sided adhesive tape 13.

The embodiment illustrated in FIG. 3 also employs a single-part assembly rail 11 made out of an extruded section. Lamp mounts 12 are attached to its front ends as in the embodiment illustrated in FIGS. 1 and 2 although this is not illustrated in FIG. 3 for simplicity's sake.

The moldings 20 and lamp sockets 21 in this embodiment preferably consist of light-metal castings with the visible surfaces plated for the sake of appearance.

A mirrored cabinet instead of a mirror 10 can of course also be suspended as described and provided with lamps at the side.

It will be appreciated that the instant specification and claims are set forth by way of illustration and not limitation, and that various modifications and changes may be made without departing from the spirit and scope of the present invention.

What is claimed is:

1. In a mirror assembly wherein a mirror has at least one lamp mounted at the side, the improvement comprising: an assembly rail securable to a wall and from which the mirror assembly is suspended and comprising three components including an intermediate member and two extremity header members, the intermediate member having one header member connected in a telescoping relation to each of its ends to allow adjustment therebetween, wherein the header members each include a front and back face with the mirror mounted to the front face; and lamp mounting means supporting each lamp and comprising a multiple component assembly including a lamp socket and molding means having one end telescopically received in the outer end of the header members opposite the intermediate member, wherein the molding means further includes a front and back face, and wherein a portion of the front face fits flush with the header member to which it is attached and wherein the lamp socket extends perpendicularly from an opening in the front face of the molding means to a point in a plane in front of the mirror; and means connecting the lamp mounting means to the assembly rail to enable the release thereof from the front of the assembly rail.

2. The mirror assembly as in claim 1, further comprising lamp terminals and a plug attached to each header member.

3. The mirror assembly as in claim 1, further comprising a plug attached to each lamp socket.

4. The mirror assembly as in claim 1, wherein the intermediate and header members comprise extruded sections.

5. The mirror assembly as in claim 1, wherein the molding means and lamp sockets comprise castings.

6. The mirror assembly as in claim 1, further comprising hanger strips with hangers that point downward and are attached to the rear of the mirror assembly.

7. The mirror assembly as in claim 6, wherein the hanger strips are attached to the mirror assembly with double-sided adhesive tape.

8. The mirror assembly as in claim 1, further comprising a hanger rail that parallels the assembly rail and is fastened to the back of the mirror assembly.

9. The mirror assembly as in claim 8, wherein the hanger rail is fastened to the mirror assembly with double-sided adhesive tape.

* * * * *